US011739678B1

(12) United States Patent
S et al.

(10) Patent No.: US 11,739,678 B1
(45) Date of Patent: Aug. 29, 2023

(54) SYSTEMS FOR EXHAUST SENSOR

(71) Applicant: Transportation IP Holdings, LLC, Norwalk, CT (US)

(72) Inventors: Annaveerayya S, Bangalore (IN); Rushikesh Ingle, Bangalore (IN)

(73) Assignee: Transportation IP Holdings, LLC, Norwalk, CT (US)

( * ) Notice: Subject to any disclaimer, the term of this patent is extended or adjusted under 35 U.S.C. 154(b) by 0 days.

(21) Appl. No.: 18/047,001

(22) Filed: Oct. 17, 2022

(51) Int. Cl.
*F01N 13/00* (2010.01)
*F01N 13/08* (2010.01)

(52) U.S. Cl.
CPC ..... *F01N 13/008* (2013.01); *F01N 13/08* (2013.01); *F01N 2560/025* (2013.01); *F05D 2220/40* (2013.01)

(58) Field of Classification Search
CPC .. F01N 13/008; F01N 13/08; F01N 2560/025; F05D 2220/40
See application file for complete search history.

(56) References Cited

U.S. PATENT DOCUMENTS

2008/0163623 A1* 7/2008 Eiraku ..... F01N 13/08 60/276

FOREIGN PATENT DOCUMENTS

WO WO-2017064884 A1 * 4/2017 ..... F01N 13/00

* cited by examiner

*Primary Examiner* — Mickey H France
*Assistant Examiner* — Edward Bushard
(74) *Attorney, Agent, or Firm* — McCoy Russell LLP

(57) ABSTRACT

Systems are provided for a sensor. In one example, a system includes a cover for a sensor mounted in a turbine casing, wherein the cover comprises a first opening configured to admit exhaust gases in a first direction normal to gravity and a second opening configured to admit exhaust gases in a second direction opposite gravity.

17 Claims, 2 Drawing Sheets

SYSTEMS FOR EXHAUST SENSOR

TECHNICAL FIELD

Embodiments of the subject matter disclosed herein relate to exhaust sensors for internal combustion engines, and more specifically, to a cover for a sensor.

DISCUSSION OF ART

Some vehicles include emission sensors to provide emissions data, which may be used to control operating parameters of an internal combustion engine (also referred to simply as the engine). One type of emission sensor is a $NO_x$ sensor. The $NO_x$ sensor may include a ceramic element. The ceramic element may heat up as it senses $NO_x$ in an exhaust gas stream.

BRIEF DESCRIPTION

In one embodiment, the current disclosure provides support for a system including a cover for a sensor, wherein the cover comprises a first opening configured to admit exhaust gases in a first direction normal to gravity and a second opening configured to admit exhaust gases in a second direction angled to gravity.

In another embodiment, the current disclosure further provides support for a turbocharger including a $NO_x$ sensor mounted in a turbine casing and a cover mounted to a flange and the turbine casing, wherein the cover comprises a first opening configured to admit exhaust gases in a first direction normal to gravity and a second opening configured to admit exhaust gases in a second direction angled to gravity.

DETAILED DESCRIPTION

Figure 1:
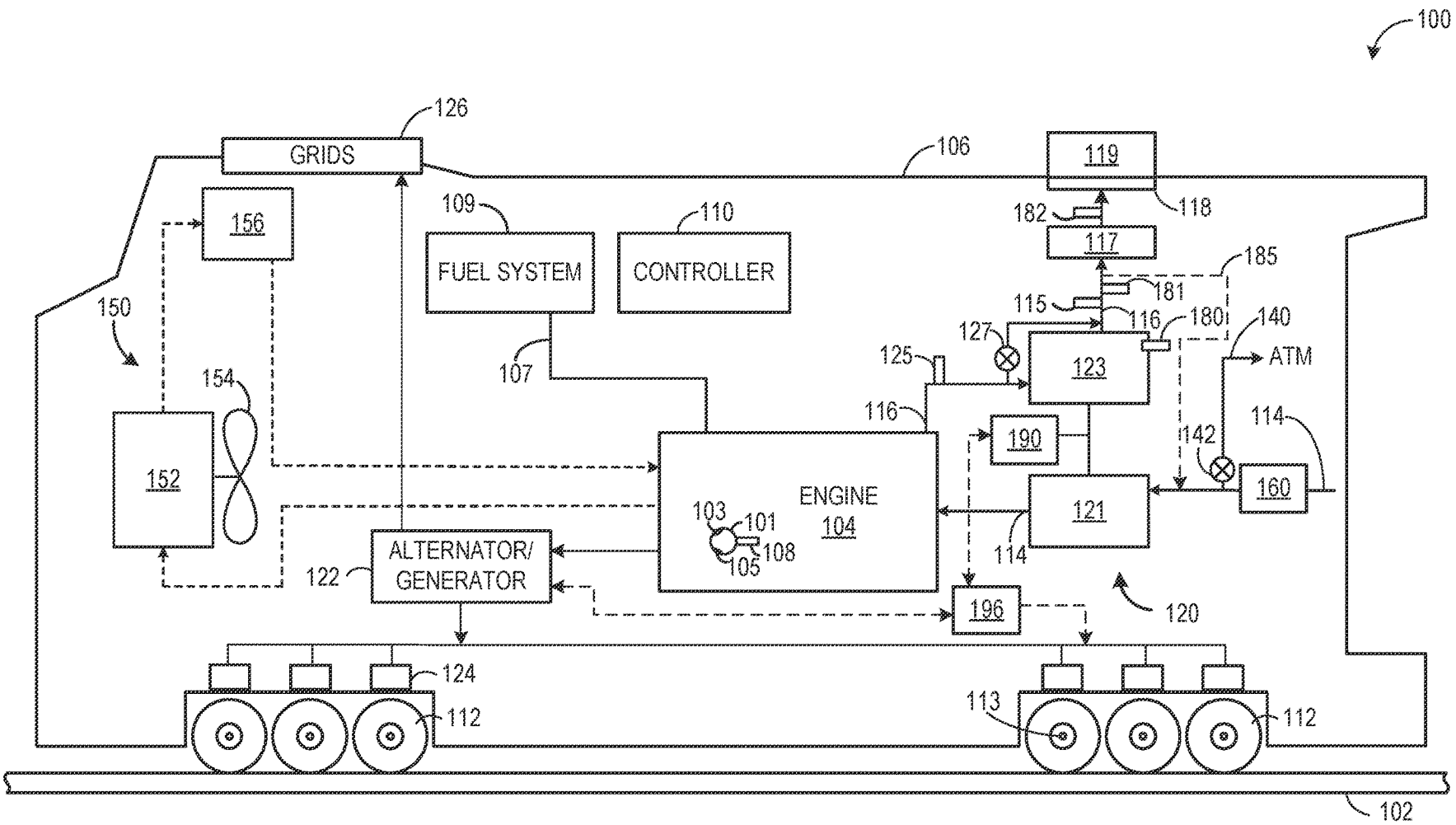
FIG. 1 shows a schematic diagram of a vehicle system with an engine, according to an embodiment of the present disclosure.
Figure 2:
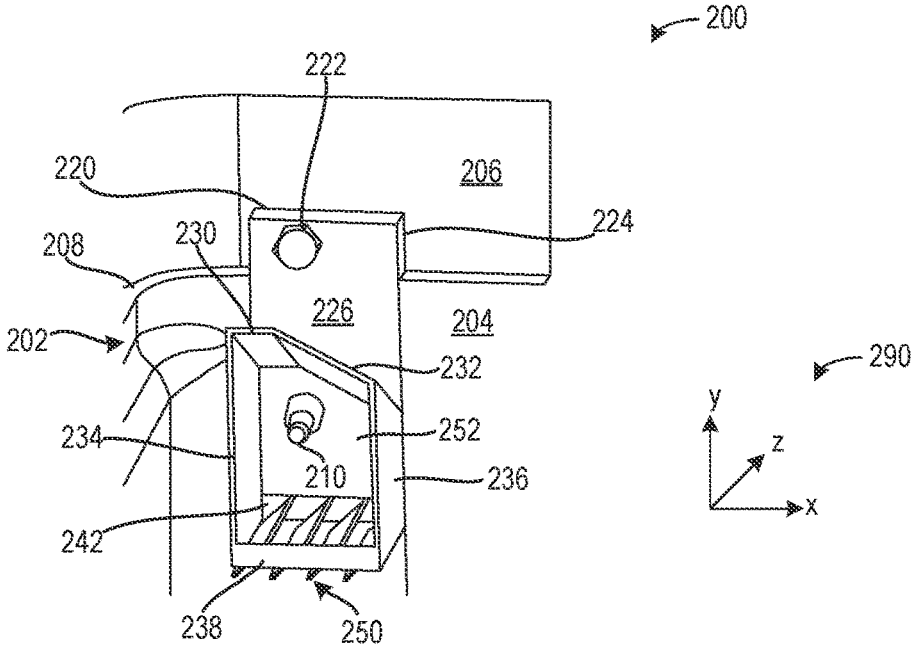
FIG. 2 shows an embodiment of a cover and a $NO_x$ sensor, according to an embodiment of the present disclosure.
Figure 3:
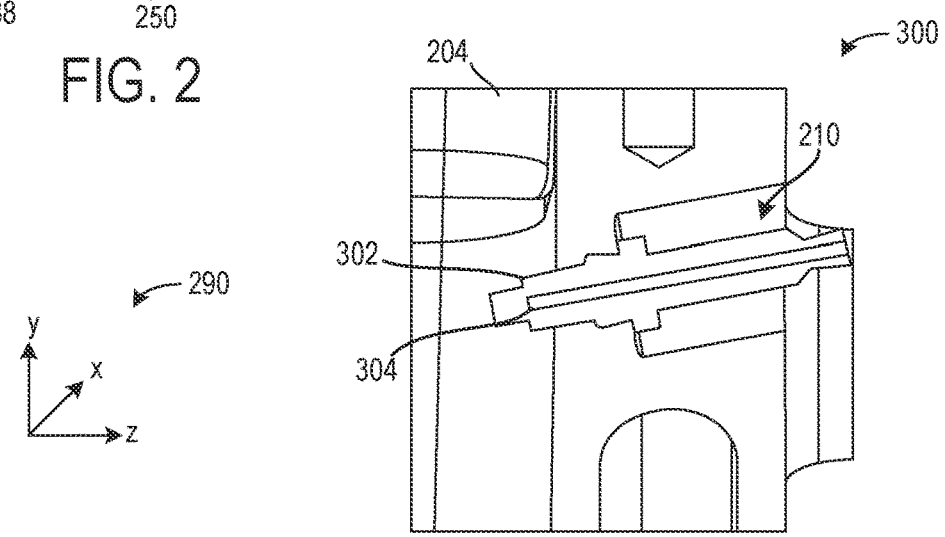
FIG. 3 shows a $NO_x$ sensor mounted in a turbocharger casing, according to an embodiment of the present disclosure.
Figure 4:
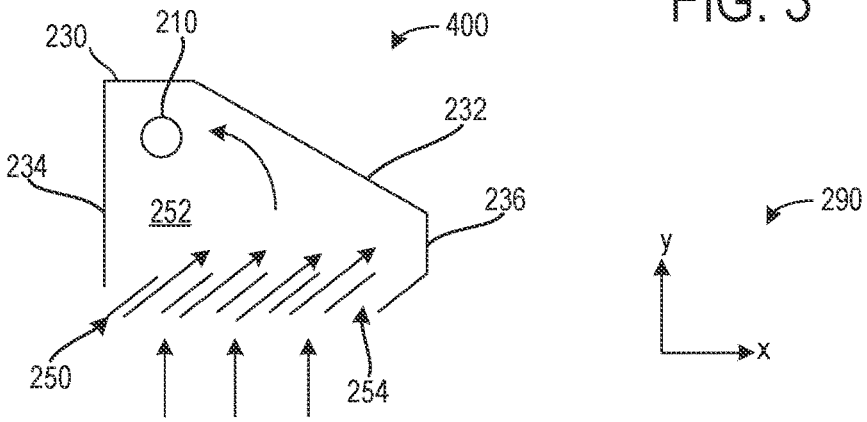
FIG. 4 shows a schematic view of the cover, according to an embodiment of the present disclosure.

This description and embodiments of the subject matter disclosed herein relate to systems for a sensor. In one example, the sensor is arranged in a turbocharger of an engine. The engine is shown in FIG. 1. The sensor may include an element that may be heated. An embodiment of the sensor mounted in a turbine casing is shown in FIG. 3. A position of the sensor may expose it to weather conditions, such as rain. A cover may surround the sensor to reduce exposure of the sensor to water droplets. FIGS. 2 and 4 illustrate example embodiments of the cover. FIGS. 2-4 are shown to scale. However, other dimensions may be used if desired.

Referring to FIG. 1, a block diagram of an embodiment of a vehicle system 100 having an engine system is shown. The vehicle system includes a vehicle 106. In the illustrated embodiment, the vehicle is a rail vehicle (e.g., a locomotive) that may operate on a rail 102 via a plurality of wheels 112 mounted on axles 113. In another embodiment, the engine system may be disposed in another type of vehicle, such as an automobile, marine vessel, or a truck. In still other embodiments, the vehicle system may include mining equipment, agricultural equipment, industrial equipment, or any other equipment that relies on tractive effort generated by a combination of one or more engines and one or more motors.

The vehicle system includes an engine 104. The engine may include a plurality of cylinders, including the cylinder 101. The plurality of cylinders may each include at least one intake valve 103, at least one exhaust valve 105, and injectors 108. Each fuel injector may include an actuator that may be actuated via a signal from a controller 110 of the engine. The cylinders of the engine may receive fuel from a fuel system 109 via a fuel conduit 107. In some examples, the fuel conduit may be coupled with a common fuel rail and the plurality of injectors. The engine may be spark-ignited or spark-free. In some examples, additionally or alternatively, the engine may combust multiple fuels including at least a first fuel and a second fuel. The first and second fuels may include at least two of gasoline, diesel, hydrogenation-derived renewable diesel (HDRD), alcohol(s), ethers, ammonia, biodiesels, hydrogen, natural gas, kerosene, syngas, and the like.

During operation, each cylinder within the engine may use a four stroke cycle. The cycle includes the intake stroke, compression stroke, expansion stroke, and exhaust stroke. During the intake stroke, generally, the exhaust valve closes and the intake valve opens. Air is introduced into the combustion chamber via the intake manifold, and the piston moves to the bottom of the cylinder so as to increase the volume within the combustion chamber. The position at which the piston is near the bottom of the cylinder and at the end of its stroke (e.g. when the combustion chamber is at its largest volume) is typically referred to by those of skill in the art as bottom dead center (BDC). During the compression stroke, the intake valve and the exhaust valve are closed. The piston moves toward the cylinder head so as to compress the air within the combustion chamber. The point at which piston is at the end of its stroke and closest to the cylinder head (e.g. when the combustion chamber is at its smallest volume) is typically referred to by those of skill in the art as top dead center (TDC). In a process hereinafter referred to as direct injection, fuel is introduced into the combustion chamber. In some examples, fuel may be injected to a cylinder a plurality of times during a single cylinder cycle. In a process hereinafter referred to as ignition, the injected fuel is ignited by compression ignition resulting in combustion. During the expansion stroke, the expanding gases push the piston back to BDC. The crankshaft converts piston movement into a rotational torque of the rotary shaft. Finally, during the exhaust stroke, the exhaust valve opens to release the combusted air-fuel mixture to the exhaust manifold and the piston returns to TDC. Note that the above is described merely as an example, and that intake and exhaust valve opening and/or closing timings may vary, such as to provide positive or negative valve overlap, late intake valve closing, or various other examples. For example, a timing of the opening and/or closing of the intake and/or exhaust valves may be advanced to reduce a temperature of exhaust gases entering an aftertreatment system of the vehicle system, to increase an efficiency of the aftertreatment system. Further, in some examples a two-stroke cycle may be used rather than a four-stroke cycle.

The engine may receive intake air for combustion from an intake passage 114. The intake air includes ambient air from outside of the vehicle flowing into the intake passage through an air filter 160. The intake passage may include and/or be coupled to an intake manifold of the engine. Exhaust gas resulting from combustion in the engine is supplied to an exhaust passage 116 via the exhaust port. Exhaust gas flows through the exhaust passage, to a muffler 118, and out of an exhaust stack 119 of the vehicle.

In one example, the vehicle is a diesel-electric vehicle, where the engine may be coupled to an electric power generation system, including an alternator/generator 122 and electric traction motors 124. The alternator/generator may additionally include a direct current (DC) generator. In other examples, the engine may be a diesel engine, a gasoline engine, a biodiesel engine, an alcohol or hydrogen engine, a natural gas engine (spark or compression ignition), or a combination of two or more of the foregoing that generates a torque output during operation. The torque output may be transmitted to the electric generator or alternator through a mechanical coupling from the engine. As depicted herein, six pairs of traction motors correspond to each of six pairs of motive wheels of the vehicle. In another example, alternator/generator may be coupled to one or more resistive grids 126 or an energy storage device. The resistive grids may dissipate as heat the electricity generated by traction motors in dynamic braking mode. The energy storage device may be used to capture dynamic braking energy, or energy from the generator directly, or energy from any one of a number of selectively coupleable sources of electricity. In some examples, additionally or alternatively, the energy storage device may pay out energy when desired.

The vehicle system may include a turbocharger 120 that may be arranged between the intake passage and the exhaust passage. The turbocharger increases air charge of ambient air drawn into the intake passage in order to provide greater charge density during combustion to increase power output and/or engine-operating efficiency. The turbocharger may include a compressor 121 (disposed in the intake passage) which may be at least partially driven by a turbine 123 (disposed in the exhaust passage). The turbine may be a fixed geometry turbine, or the turbine may be a variable geometry turbine, where a variable vane control adjusts a position of variable geometry turbine vanes. Exhaust gases may pass through the turbine supplying less energy to rotate the turbine when vanes are in an open position, while exhaust gases may pass through the turbine and impart increased energy on the turbine when vanes are in a closed position. As the turbine rotates, heat and kinetic energy in the exhaust gases may be converted into mechanical energy, which may be used to drive the compressor of the turbocharger to deliver compressed air to the engine intake (e.g., to provide a pressure boost to cylinders of the engine based on engine operating conditions). While a single turbocharger is included in FIG. 1, the system may include multiple turbine and/or compressor stages. The turbine may include a turbine speed sensor 180, and a turbine inlet temperature sensor 125 may be positioned in the exhaust passage, upstream of an inlet of the turbine.

In another embodiment, the turbocharger may be an e-turbo, where an electrical machine 190 mechanically coupled to the turbine may convert the mechanical energy into electrical energy. The e-turbo may be integrated into a shaft of the turbocharger, where the compressor and the turbine are mechanically linked. The e-turbo may be operated as a motor/generator that can be used to motor the shaft (e.g., speed it up) to increase a work output of the compressor or slow the shaft down to extract excess energy. While operating in a generating mode, extracting the excess exhaust energy may result in improved overall engine efficiency. While operating in a motoring mode, the compressor may provide additional airflow to the engine, which may improve a combustion and/or an emissions of the vehicle. Additionally, the electrical energy may be used to power one or more accessory devices of the vehicle, such as an electric motor, and/or stored in an energy storage device 196 (e.g., a battery, capacitor bank, or electro-chemical converter). In one example, the electric motor powers one or more wheels of the vehicle.

The vehicle system may also include a compressor bypass passage 140 coupled directly to the intake passage, upstream of the compressor and upstream of the engine. In one example, the compressor bypass passage may be coupled to the intake passage, upstream of the intake manifold of the engine. The compressor bypass passage may divert airflow (e.g., from before the compressor inlet) away from the engine (or intake manifold of the engine) and to atmosphere. A compressor bypass valve (CBV) 142 may be positioned in the compressor bypass passage and may include an actuator that may be controlled by the controller to adjust the amount of intake airflow diverted away from the engine and to atmosphere.

Additionally, a wastegate 127 may be disposed in a bypass passage around the turbine, which may be adjusted, via actuation from the controller, to increase or decrease exhaust gas flow through the turbine. For example, opening the wastegate (or increasing the amount of opening) may decrease exhaust flow through the turbine and correspondingly decrease the rotational speed of the compressor. As a result, less air may enter the engine, thereby decreasing the combustion air-fuel ratio.

As will be described in greater detail herein, operation of the e-turbo may be adjusted in response to vehicle conditions to achieve a desired parameter. The e-turbo may supply power to at least one axle of the vehicle system. In one example, the e-turbo supplies power to only one axle of the vehicle system and the engine may supply power to the remaining axles. During some conditions, it may not be desired to power the one axle via the e-turbo. The engine may provide power to all six axles during some conditions where the e-turbo speed may exceed a limit speed. In one example, the limit speed is based on a determined speed of the turbo at or above a manufacturing tolerance of the turbo at which degradation may occur. The embodiments described herein may be applied to vehicles including more than six or less than six axles. Operation may include prophylactically avoiding conditions where the e-turbo does not power the at least one axle, which may prioritize use of the e-turbo. However, upon reaching a threshold, the wastegate may be opened and usage of the e-turbo reduced.

The vehicle system may further include a cooling system 150 (e.g., an engine cooling system). The cooling system may circulate coolant through the engine to absorb waste engine heat to distribute to a heat exchanger, such as a radiator 152 (e.g., a radiator heat exchanger). In one example, the coolant may be water, anti-freeze, or a mixture of the two. In another example, the coolant may be oil. A fan 154 may be further coupled to the radiator to maintain an airflow through the radiator when the vehicle is moving slowly or stopped while the engine is running. In some examples, a fan speed may be controlled by the controller. Coolant that is cooled by the radiator may enter a tank (not shown in FIG. 1). The coolant may then be pumped by a pump 156 back to the engine or to another component of the vehicle system.

The vehicle system may include an aftertreatment system 117 coupled in the exhaust passage downstream of the turbocharger. In one embodiment, the aftertreatment system may include a diesel oxidation catalyst (DOC) and a diesel particulate filter (DPF). In other embodiments, the aftertreatment system may additionally or alternatively include one or more emission control devices. Such emission control devices may include a selective catalytic reduction (SCR) catalyst, three-way catalyst, $NO_x$ trap, or various other devices or systems. In one example, an aftertreatment temperature sensor 115 is arranged at or upstream of an inlet of the aftertreatment system, which may measure a temperature of exhaust gas prior to entering the aftertreatment system. Additionally, one or more AFR sensors or oxygen ($O_2$) sensors may be arranged on an exhaust conduit upstream and/or downstream of the aftertreatment system. For example, an AFR sensor or $O_2$ sensor 181 may be arranged at the inlet of the aftertreatment system, which may estimate an AFR of the engine from the exhaust gas prior to entering the aftertreatment system, or an AFR sensor or $O_2$ sensor 182 may be arranged downstream of the aftertreatment system (e.g., at an exhaust pipe), which may estimate the AFR from exhaust gas exiting the aftertreatment system.

Catalysts are shown to exhibit a maximum (e.g., peak) $NO_x$ conversion at a particular exhaust gas temperature. As such, for minimizing vehicle emissions, it may be desirable to maintain temperatures within a range of temperatures near a peak conversion of the catalyst used in the exhaust gas aftertreatment system. For example, no oxidation or conversion may occur at low exhaust gas temperatures (e.g., below approximately 120° C.). As a temperature of a catalyst in the aftertreatment system increases, the oxidation or conversion rates may increase. As the catalyst temperature is raised above a threshold temperature (e.g., 150° C.), the conversion rates may increase steeply with increasing temperature to maximum conversions rates (e.g., 90% for carbon monoxide (CO) and 70% for hydrocarbon (HC)). At high temperatures (e.g., 250° C.-350° C.), the catalyst performance stabilizes to form a characteristic plateau on the light-off curve. As such, it may be desirable, for minimizing vehicle emissions, to maintain exhaust gas temperatures above the plateau temperature, within a range in which typical exhaust gas aftertreatment systems exhibit near maximum conversion efficiency.

The vehicle system may include an exhaust gas recirculation (EGR) system 185 coupled to the engine. The EGR system may route exhaust gas from the exhaust passage of the engine to the intake passage downstream of the turbocharger. In some embodiments, the exhaust gas recirculation system may be coupled exclusively to a group of one or more donor cylinders of the engine (also referred to as a donor cylinder system).

The controller may control various components and operations related to the vehicle. As an example, various components of the vehicle system may be coupled to the controller via a communication channel or data bus. In one example, the controller includes a computer control system. The controller may additionally or alternatively include a memory holding non-transitory computer readable storage media (not shown) including code for enabling on-board monitoring and control of vehicle operation. In some examples, the controller may include more than one controller each in communication with one another, such as a first controller to control the engine and a second controller to control other operating parameters of the vehicle (such as engine load, engine speed, brake torque, etc.). The first controller may control various actuators based on output received from the second controller and/or the second controller may control various actuators based on output received from the first controller.

The controller may receive information from a plurality of sensors and may send control signals to a plurality of actuators. The controller, while overseeing control and management of the vehicle, may receive signals from a variety of engine sensors. The signals may be used to determine operating parameters and operating conditions, and correspondingly adjust various engine actuators to control operation of the vehicle. For example, the engine controller may receive signals from various engine sensors including, but not limited to, engine speed, engine load (derived from fueling quantity commanded by the engine controller, turbocharger speed, fueling quantity indicated by measured fuel system parameters, averaged mean-torque data, manifold pressure, and/or electric power output from the alternator or generator), mass airflow amount/rate (e.g., via a mass airflow meter), intake manifold air pressure, boost pressure, exhaust pressure, ambient pressure, ambient temperature, exhaust temperature (such as the exhaust temperature entering the turbine, as determined from the turbine inlet temperature sensor, or the exhaust temperature entering the aftertreatment system, as determined from the inlet temperature sensor), particulate filter temperature, particulate filter back pressure, engine coolant pressure, exhaust oxides-of-nitrogen quantity (from $NO_x$ sensor), exhaust soot quantity (from soot/particulate matter sensor), exhaust gas oxygen level sensor, or the like. Correspondingly, the controller may control the vehicle by sending commands to various components such as the traction motors, the alternator/generator, cylinder valves, fuel injectors, a notch throttle, the compressor bypass valve (or an engine bypass valve in alternate embodiments), the wastegate, or the like. Other actively operating and controlling actuators may be coupled to various locations in the vehicle.

Further, the controller may monitor an engine throttle setting. This may be performed for an engine governor. For example, the engine governor may react to the engine throttle setting in order to adjust engine operation. In one embodiment, the throttle setting may be infinitely adjustable. In another embodiment, an operator of the vehicle may adjust an input device between a plurality of determined engine notch settings. Based on the selected engine notch setting, the controller may adjust engine operation to provide the desired engine performance (e.g., such as a desired vehicle speed). An increase in the numerical value of the notch may correspond (directly or indirectly) with an increase in vehicle speed and/or with engine power output. It may adjust fuel injection timing and fuel rail pressure. For example, notch 0 may correspond to engine idle, notch 4 may provide a mid-level of engine speed, and notch 8 may be the maximum throttle setting. For example, the controller may adjust engine revolutions per minute (RPM), gearing, valve timings, and other parameters in order to move the vehicle at a speed corresponding to the selected engine notch. For example, the engine may be adjusted to generate more power in order to increase the vehicle speed, or to accommodate a heavy load (e.g., due to cargo and/or grade) at a lower vehicle speed.

Turning now to FIG. 2, it shows an embodiment 200 illustrating a turbine 202 and a sensor 210. Herein, the sensor is a $NO_x$ sensor. An axis system 290 is shown including three axes, namely an x-axis parallel to a horizontal direction, a y-axis parallel to a vertical direction, and a z-axis normal to each of the x- and y-axes.

The $NO_x$ sensor is mounted in a turbine casing 204 of the turbine. In the example of FIG. 3, a cross-sectional view 300 of the $NO_x$ sensor 210 is shown. The $NO_x$ sensor may include a casing 302 and a sensor element 304. A tip of the sensor element may protrude through the turbine casing and into an interior volume thereof. The turbine case is arranged below an exhaust stack of the turbine. Exhaust gases may swirl within the turbine case and flow up to the exhaust stack. A portion of the exhaust gases may flow to the $NO_x$ sensor on the way to the exhaust stack.

The casing at least partially surrounds (e.g., houses) the sensor element. The casing may admit exhaust gases to the sensor element. The casing may block an amount of water and other environmental elements from flowing to the sensor element. However, during certain ambient and/or operating conditions, water may reach the sensor element, which may be undesired.

When a temperature of the sensor element of the $NO_x$ sensor is greater than a threshold temperature, it may be undesired to allow water to contact the sensor element, as this may result in cracks or other forms of degradation. Water may enter the turbine case via the exhaust stack. The water droplets, which may be provided via condensate or rain, may swirl within the turbine case. Thus, water flow toward the $NO_x$ sensor may travel along multiple paths. A first path may be parallel to a direction of gravity, which is parallel to the y-axis. A second path may be opposite or angled to the direction of gravity.

A cover 220 may be physically coupled to a flange 206 of the turbine via a fastener 222. The cover may be arranged to surround the $NO_x$ sensor separately from the casing (e.g., casing 302 of FIG. 3). In one example, the $NO_x$ sensor and the cover are arranged near a corner of the turbine casing. Gases may flow in a plurality of directions in the turbine casing. Gases may flow parallel to gravity, against gravity, and normal and/or angled to gravity. The cover may include openings to admit exhaust gases in directions normal to and against gravity. Near the corner, an amount of swirling exhaust gases may be reduced relative to central portions of the turbine casing, resulting in more predictable gas flow. In some embodiments, additionally or alternatively, the positioning of the cover and the $NO_x$ sensor may be adjusted, such as between adjacent corners or further from the corner.

The fastener may extend through a mounting surface 224 of the cover. The mounting surface may be pressed against the flange and a lip 208 of the turbine casing. The lip may protrude toward the interior volume of the turbine casing relative to the flange.

A back wall 226 may extend from the mounting surface. The back wall may be pressed against a portion of the turbine casing below the lip. In one example, the mounting surface and the back wall may comprise an L-shape. A thickness of the mounting surface may be greater than a thickness of the back wall, wherein the thickness is measured along the z-axis.

The cover further comprises a first roof surface 230, a second roof surface 232, a first side wall 234, a second side wall 236, a front bracket 238, and a back bracket 242. Surfaces of the cover may be metal, in one example. In some embodiments, additionally or alternatively, the cover may include other materials, including one or more of polymers, aluminum, carbon fiber, magnesium, cast iron, stainless steel, steel, alloys, and titanium.

The first roof surface may be upwardly angled to a y-z plane at a first angle. The second roof surface may be upwardly angled at the first angle and slanted at a second angle relative to an x-z plane. The first roof surface may be coupled to each of the second roof surface and the first side wall. The second roof surface may be coupled to the first roof surface and the second side wall. The first side wall and the second side wall may be parallel to one another and a y-z plane. Due to the slant and/or angle of the second roof surface, a height of the second side wall may be less than a height of the first side wall, the height measured along the y-axis.

The front bracket may be coupled to a front edge of the first side wall and the second side wall. The back bracket may be coupled to a back edge of the first side wall and the second side wall, wherein the back edge is opposite the front edge. The back bracket may be in face-sharing contact with the turbine casing. The front bracket may be spaced away from the turbine casing. In one example, the front bracket is separated from the back bracket via an entire width of the first and second side walls.

A plurality of vanes 250 may be arranged between the front bracket and the back bracket. Additionally, the plurality of vanes may be arranged between lower portions of the first side wall and the second side wall. The plurality of vanes may be slanted at a third angle relative to the x-z plane. In one example, the third angle is opposite the second angle. As such, each of the plurality of vanes may be normal to the second roof surface.

The plurality of vanes may be immobile. In some examples, additionally or alternatively, the plurality of vanes may be actuated in response to one or more of an exhaust mass flow rate and weather conditions. For example, the plurality of vanes may be actuated to a more closed position in response to the weather conditions including rain. Additionally or alternatively, the plurality of vanes may be actuated to a more open position, which allows greater exhaust flow into the cover compared to the more closed position, in response to the exhaust mass flow rate being less than a determined value.

The cover may direct exhaust gas flow toward the $NO_x$ sensor at a desired flow rate via a plurality of openings while limiting large water droplets from reaching the $NO_x$ sensor via its surfaces and the vanes. In one example, the cover is configured to disrupt each of a first travel path parallel to gravity and a second travel path opposite or against gravity. The first roof surface and the second roof surface disrupt the first travel path. The combination of the plurality of vanes and the second roof surface may disrupt the second travel path. In one example, an outer surface of the second roof surface may contact water droplets following the first travel path and an inner surface of the second roof surface may contact water droplets following the second travel path.

Exhaust gases may enter the cover via a first opening 252. The first opening may be defined via each of the first roof surface, the second roof surface, the first side wall, the second side wall, and the front bracket. Exhaust gases entering the cover via the first opening may flow in a first direction parallel to the z-axis. Larger water droplets may not flow through the first opening via the first and second roof surfaces and the front bracket. The first opening is parallel to a x-y plane.

Exhaust gases may also enter the cover via a second opening 254. The second opening may be defined via the first side wall, the second side wall, the front bracket, and the back bracket. The plurality of vanes may divide the second opening into multiple, discontinuous openings. Swirling exhaust gases may flow through gaps between each of the plurality of vanes and into the cover toward the sensor in a second direction angled to the x- and y-axes. The second direction may be angled to the first direction of exhaust gases flowing through the first opening. The second opening is parallel to a x-z plane.

Turning now to FIG. 4, it shows a cross-section 400 taken along the x-y plane of the $NO_x$, sensor and the cover. Exhaust gases, which may contain water droplets, may swirl in the turbine case and enter the cover via the second opening. The exhaust gases may flow in a direction opposite gravity toward the second opening. As the exhaust gases pass through the plurality of vanes, the exhaust gases execute a first turn and flow in a direction parallel to the third angle. The exhaust gases flow toward the second roof surface and execute a second turn in a direction parallel to the second angle. In one example, the second turn is normal to the first turn.

The combination of the plurality of vanes and the two turns may mitigate larger droplets from reaching the $NO_x$ sensor. In a first example, the plurality of vanes may be hot and larger water droplets may evaporate upon contacting a vane of the plurality of vanes. In a second example, the travel path of exhaust gases through the cover, with the two turns, may deter larger droplets from reaching the $NO_x$ sensor.

The technical effect of the cover is to provide additional protection to the sensor element outside of the casing. The cover includes a plurality of angled surfaces configured to disrupt water droplet flow toward the sensor while still providing a desired exhaust flow rate for sensing exhaust gas constituents.

The disclosure provides support for a system including a cover for a sensor mounted in a turbine casing, wherein the cover comprises a first opening configured to admit exhaust gases in a first direction normal to gravity and a second opening configured to admit exhaust gases in a second direction angled to gravity. A first example of the system further includes where the cover comprises a first roof surface and a second roof surface, wherein the second roof surface is slanted relative to the first roof surface. A second example of the system, optionally including the first example, further includes where the second opening is below the first opening. A third example of the system, optionally including one or more of the previous examples, further includes where a plurality of vanes is arranged in the second opening. A fourth example of the system, optionally including one or more of the previous examples, further includes where the plurality of vanes is angled relative to the second direction. A fifth example of the system, optionally including one or more of the previous examples, further includes where the plurality of vanes direct exhaust gases to an interior of the cover away from the sensor. A sixth example of the system, optionally including one or more of the previous examples, further includes where the sensor is a $NO_x$ sensor. A seventh example of the system, optionally including one or more of the previous examples, further includes where the cover and the sensor are arranged adjacent to a corner of the turbine casing.

The disclosure further provides support for a turbocharger including a $NO_x$ sensor mounted in a turbine casing and a cover mounted to a flange and the turbine casing, wherein the cover comprises a first opening configured to admit exhaust gases in a first direction normal to gravity and a second opening configured to admit exhaust gases in a second direction angled to gravity. A first example of the turbocharger further comprises where the cover comprises a first roof surface normal to gravity, a second roof surface angled to the first roof surface and gravity, a first side wall parallel to a second side wall and gravity, and a front bracket and a back bracket coupled to the first side wall and the second side wall. A second example of the turbocharger, optionally including the first example, further includes where the first opening is between edges of the first roof surface, the second roof surface, the first side wall, the second side wall, and the front bracket. A third example of the turbocharger, optionally including one or more of the previous examples, further includes where the second opening is between edges of the first side wall, the second side wall, the front bracket, and the back bracket, wherein the second opening is below the first opening. A fourth example of the turbocharger, optionally including one or more of the previous examples, further includes where a plurality of vanes is coupled to the front bracket and the back bracket, wherein the plurality of vanes is angled to gravity and normal to the second roof surface. A fifth example of the turbocharger, optionally including one or more of the previous examples, further includes where exhaust gases flowing through the second opening execute a first turn flowing through the plurality of vanes and a second turn after contacting the second roof surface. A sixth example of the turbocharger, optionally including one or more of the previous examples, further includes where the $NO_x$ sensor comprises a sensor element surrounded by a casing.

The disclosure additional provides support for a turbocharger including a $NO_x$ sensor mounted in a turbine casing, a cover mounted to a flange and the turbine casing, wherein the cover comprises a first opening configured to admit exhaust gases in a first direction normal to gravity and a second opening configured to admit exhaust gases in a second direction angled to gravity, wherein the cover comprises a first roof surface normal to gravity, a second roof surface angled to the first roof surface and gravity, a first side wall parallel to a second side wall and gravity, and a front bracket and a back bracket coupled to the first side wall and the second side wall, and a plurality of vanes is coupled to the front bracket and the back bracket, wherein the plurality of vanes is angled to gravity and normal to the second roof surface. A first example of the turbocharger further includes where the first opening is between edges of the first roof surface, the second roof surface, the first side wall, the second side wall, and the front bracket, and wherein the second opening is between edges of the first side wall, the second side wall, the front bracket, and the back bracket, wherein the second opening is below the first opening. A second example of the turbocharger, optionally including the first example, further includes where the plurality of vanes direct gases through the second opening toward the second roof surface. A third example of the turbocharger, optionally including one or more of the previous examples, further includes where the cover and the $NO_x$ sensor are adjacent to a corner of the turbine casing and distal to a center. A fourth example of the turbocharger, optionally including one or more of the previous examples, further includes where gases flowing through the second opening turn at least twice prior to flowing to the $NO_x$ sensor.

In one embodiment, the control system, or controller, may have a local data collection system deployed and may use machine learning to enable derivation-based learning outcomes. The controller may learn from and make decisions on a set of data (including data provided by the various sensors), by making data-driven predictions and adapting according to the set of data. In embodiments, machine learning may involve performing a plurality of machine learning tasks by machine learning systems, such as supervised learning, unsupervised learning, and reinforcement learning. Supervised learning may include presenting a set of example inputs and desired outputs to the machine learning systems. Unsupervised learning may include the learning algorithm structuring its input by methods such as pattern detection and/or feature learning. Reinforcement learning may include the machine learning systems performing in a dynamic environment and then providing feedback about correct and incorrect decisions. In examples, machine learning may include a plurality of other tasks based on an output of the machine learning system. The tasks may be machine learning problems such as classification, regression, clustering, density estimation, dimensionality reduction, anomaly detection, and the like. In examples, machine learning may include a plurality of mathematical and statistical techniques. The machine learning algorithms may include decision tree based learning, association rule learning, deep learning, artificial neural networks, genetic learning algorithms, inductive logic programming, support vector machines (SVMs), Bayesian network, reinforcement learning, representation learning, rule-based machine learning, sparse dictionary learning, similarity and metric learning, learning classifier systems (LCS), logistic regression, random forest, K-Means, gradient boost, K-nearest neighbors (KNN), a priori algorithms, and the like. In embodiments, certain machine learning algorithms may be used (e.g., for solving both constrained and unconstrained optimization problems that may be based on natural selection). In an example, the algorithm may be used to address problems of mixed integer programming, where some components are restricted to being integer-valued. Algorithms and machine learning techniques and systems may be used in computational intelligence systems, computer vision, Natural Language Processing (NLP), recommender systems, reinforcement learning, building graphical models, and the like. In an example, machine learning may be used for vehicle performance and control, behavior analytics, and the like.

In one embodiment, the controller may include a policy engine that may apply one or more policies. These policies may be based at least in part on characteristics of a given item of equipment or environment. With respect to control policies, a neural network can receive input of a number of environmental and task-related parameters. The neural network can be trained to generate an output based on these inputs, with the output representing an action or sequence of actions that the engine system should take. This may be useful for balancing competing constraints on the engine. During operation of one embodiment, a determination can occur by processing the inputs through the parameters of the neural network to generate a value at the output node designating that action as the desired action. This action may translate into a signal that causes the engine to operate. This may be accomplished via back-propagation, feed forward processes, closed loop feedback, or open loop feedback. Alternatively, rather than using backpropagation, the machine learning system of the controller may use evolution strategies techniques to tune various parameters of the artificial neural network. The controller may use neural network architectures with functions that may not always be solvable using backpropagation, for example functions that are non-convex. In one embodiment, the neural network has a set of parameters representing weights of its node connections. A number of copies of this network are generated and then different adjustments to the parameters are made, and simulations are done. Once the output from the various models are obtained, they may be evaluated on their performance using a determined success metric. The best model is selected, and the vehicle controller executes that plan to achieve the desired input data to mirror the predicted best outcome scenario. Additionally, the success metric may be a combination of the optimized outcomes. These may be weighed relative to each other.

As used herein, an element or step recited in the singular and preceded with the word "a" or "an" should be understood as not excluding plural of said elements or steps, unless such exclusion is explicitly stated. Furthermore, references to "one embodiment" of the invention do not exclude the existence of additional embodiments that also incorporate the recited features. Moreover, unless explicitly stated to the contrary, embodiments "that includes," "including," or "having" an element or a plurality of elements having a particular property may include additional such elements not having that property. The terms "including" and "in which" are used as the plain-language equivalents of the respective terms "that includes" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the clauses, and may include other examples that occur to those of ordinary skill in the art. Such other examples are intended to be within the scope of the clauses if they have structural elements that do not differ from the literal language of the clauses, or if they include equivalent structural elements with insubstantial differences from the literal languages of the clauses.

The invention claimed is:

1. A system, comprising:

a cover for a sensor mounted in a turbine casing, wherein the cover comprises a first opening configured to admit exhaust gases in a first direction normal to gravity and a second opening configured to admit exhaust gases in a second direction at an angle between 0 and 90 degrees to the first direction; and a plurality of vanes is arranged in the second direction in the second opening.

2. The system of claim 1, wherein the cover comprises a first roof surface and a second roof surface, wherein the second roof surface is slanted relative to the first roof surface.

3. The system of claim 1, wherein the second opening is below the first opening.

4. The system of claim 1, wherein the plurality of vanes is angled relative to the second direction.

5. The system of claim 1, wherein the plurality of vanes direct exhaust gases to an interior of the cover away from the sensor.

6. The system of claim 1, wherein the sensor is a $NO_x$ sensor.

7. The system of claim 1, wherein the cover and the sensor are arranged adjacent to a corner of the turbine casing.

8. A turbocharger, comprising:

a NOx sensor mounted in a turbine casing; and a cover mounted to a flange and the turbine casing, wherein the cover comprises a first opening, parallel to a first plane, configured to admit exhaust gases in a first direction and a second opening, parallel to a second plane, the second plane normal to the first plane, configured to admit exhaust gases in a second direction within the first plane and angled to the first direction between 0 and 90 degrees, a first roof surface, a second roof surface angled to the first roof surface, a first side wall parallel to a second side wall and normal to the first roof surface, and a front bracket and a back bracket coupled to the first side wall and the second side wall; and a plurality of vanes is coupled to the front bracket and the back bracket, wherein the plurality of vanes is angled in the second direction and angled to the first side wall and the second side wall and normal to the second roof surface.

9. The turbocharger of claim 8, wherein the first opening is between edges of the first roof surface, the second roof surface, the first side wall, the second side wall, and the front bracket.

10. The turbocharger of claim 8, wherein the second opening is between edges of the first side wall, the second side wall, the front bracket, and the back bracket, wherein the second opening is below the first opening.

11. The turbocharger of claim 8, wherein exhaust gases flowing through the second opening execute a first turn flowing through the plurality of vanes and a second turn after contacting the second roof surface.

12. The turbocharger of claim 8, wherein the $NO_x$ sensor comprises a sensor element surrounded by a casing.

13. A turbocharger, comprising:

a NOx sensor mounted in a turbine casing; a cover mounted to a flange and the turbine casing, wherein the cover comprises a first opening configured to admit exhaust gases in a first direction normal to gravity and a second opening configured to admit exhaust gases in a second direction angled toward side walls of the cover, wherein the cover comprises a first roof surface, a second roof surface angled to the first roof surface and gravity, wherein the side walls comprise a first side wall parallel to a second side wall, each of the first side wall and the second side wall are normal to the first roof surface, and a front bracket and a back bracket coupled to the first side wall and the second side wall; and a plurality of vanes is coupled to the front bracket and the back bracket, wherein the plurality of vanes is angled in the second direction and the first side wall and the second side wall and normal to the second roof surface.

14. The turbocharger of claim 13, wherein the first opening is between edges of the first roof surface, the second roof surface, the first side wall, the second side wall, and the front bracket, and wherein the second opening is between edges of the first side wall, the second side wall, the front bracket, and the back bracket, wherein the second opening is below the first opening.

15. The turbocharger of claim 13, wherein the plurality of vanes direct gases through the second opening toward the second roof surface.

16. The turbocharger of claim 13, wherein the cover and the $NO_x$ sensor are adjacent to a corner of the turbine casing and distal to a center.

17. The turbocharger of claim 13, wherein gases flowing through the second opening turn at least twice prior to flowing to the $NO_x$ sensor.

* * * * *